US009346183B2

(12) United States Patent
Fankhauser et al.

(10) Patent No.: US 9,346,183 B2
(45) Date of Patent: May 24, 2016

(54) TOOL CLAMPING DEVICE

(75) Inventors: Marcel Fankhauser, Bern (CH); Bruno Luescher, Zofingen (CH)

(73) Assignee: Robert Bosch GmbH, Stuttgart (DE)

( * ) Notice: Subject to any disclaimer, the term of this patent is extended or adjusted under 35 U.S.C. 154(b) by 294 days.

(21) Appl. No.: 14/005,641

(22) PCT Filed: Feb. 2, 2012

(86) PCT No.: PCT/EP2012/051725

§ 371 (c)(1),
(2), (4) Date: Nov. 25, 2013

(87) PCT Pub. No.: WO2012/126661

PCT Pub. Date: Sep. 27, 2012

(65) Prior Publication Data

US 2014/0070500 A1 Mar. 13, 2014

(30) Foreign Application Priority Data

Mar. 18, 2011 (DE) ..... 10 2011 005 821

(51) Int. Cl.
*B27B 19/00* (2006.01)
*B27B 5/32* (2006.01)

(52) U.S. Cl.
CPC ..... *B27B 19/006* (2013.01); *B27B 5/32* (2013.01); *Y10T 279/33* (2015.01)

(58) Field of Classification Search
CPC ..... B27B 5/30; B27B 5/32; B27B 19/006; Y10T 279/33; B23D 61/10
USPC ..... 279/141
See application file for complete search history.

(56) References Cited

U.S. PATENT DOCUMENTS

| | | | | | |
|---|---|---|---|---|---|
| 3,943,934 | A | | 3/1976 | Bent | |
| 4,106,181 | A | | 8/1978 | Mattchen | |
| 5,263,972 | A | * | 11/1993 | Evans | A61B 17/14 30/339 |
| 5,468,247 | A | | 11/1995 | Matthai et al. | |
| 8,852,221 | B2 | * | 10/2014 | Boykin | A61B 17/14 606/171 |
| 8,881,409 | B2 | * | 11/2014 | Haman | B27B 19/006 173/217 |
| 8,920,424 | B2 | * | 12/2014 | Boykin | A61B 17/14 606/82 |

(Continued)

FOREIGN PATENT DOCUMENTS

| | | | | | |
|---|---|---|---|---|---|
| CH | 685154 | A5 | * | 4/1995 | A61B 17/14 |
| CN | 1706596 | A | | 12/2005 | |
| CN | 101003119 | A | | 7/2007 | |
| CN | 101043987 | A | | 9/2007 | |
| DE | 27 35 540 | A1 | | 2/1978 | |
| DE | WO 2004105623 | A1 | * | 12/2004 | A61B 17/14 |

(Continued)

OTHER PUBLICATIONS

International Search Report corresponding to PCT Application No. PCT/EP2012/051725, mailed Apr. 12, 2012 (German and English language document) (5 pages).

*Primary Examiner* — Eric A Gates
(74) *Attorney, Agent, or Firm* — Maginot, Moore & Beck LLP

(57) ABSTRACT

A tool clamping device, in particular an oscillating tool clamping device, includes a clamping unit that has at least one clamping element configured to securely clamp a working tool in an axial direction and at least one clamping head arranged on the clamping element and configured to clamp the working tool at a free end of the clamping unit. The clamping unit further includes a guiding unit configured to guide at least one movement of the working tool along at least one direction of movement that deviates significantly from the axial direction in at least one operating state.

11 Claims, 3 Drawing Sheets

(56) References Cited

U.S. PATENT DOCUMENTS

| | | | | |
|---|---|---|---|---|
| 8,925,931 | B2 * | 1/2015 | Sergyeyenko | B24B 23/04 279/141 |
| 2014/0084552 | A1 * | 3/2014 | Zieger | B24B 23/022 279/141 |

FOREIGN PATENT DOCUMENTS

| | | | | |
|---|---|---|---|---|
| DE | 102012007931 | A1 * | 10/2013 | B24B 23/022 |
| EP | 0 776 634 | A2 | 6/1997 | |
| WO | 2007/012882 | A1 | 2/2007 | |

* cited by examiner

TOOL CLAMPING DEVICE

This application is a 35 U.S.C. §371 National Stage Application of PCT/EP2012/051725, filed on Feb. 2, 2012, which claims the benefit of priority to Serial No. DE 10 2011 005 821.4, filed on Mar. 18, 2011 in Germany, the disclosures of which are incorporated herein by reference in their entirety.

BACKGROUND

There are already known tool clamping devices that comprise a clamping unit. The clamping unit in this case has a clamping element for securely clamping a working tool in an axial direction, and has a clamping head, which is disposed on the clamping element and which is provided for clamping the working tool at a free end of the clamping unit.

SUMMARY

The disclosure is based on a tool clamping device, in particular an oscillating-tool clamping device, comprising a clamping unit that has at least one clamping element for securely clamping a working tool in an axial direction, and has at least one clamping head, which is disposed on the clamping element and which is provided for clamping the working tool at a free end of the clamping unit.

It is proposed that the clamping unit have a guide unit, which is provided for guiding at least one movement of the working tool along at least one movement direction that differs substantially from the axial direction, in at least one operating state. A "clamping unit" is to be understood here to mean, in particular, a unit that secures a working tool along the axial direction by means of a form-fit and/or by means of a force-fit. In particular, the clamping unit has an operating unit. The term "operating unit" is intended here to define, in particular, a unit having at least one operating element that can be actuated directly by an operator, and which is provided to influence and/or alter a process and/or a state of a unit coupled to the operating element, through an actuation and/or through an input of parameters. A "working tool" is to be understood to mean, in particular, a blade-type tool that is provided, in particular, for performing material-removing work, preferably sawing, on a workpiece. The term "axial direction" is intended here to define, in particular, a direction that runs preferably at least substantially parallelwise in relation to a pivot axis and/or rotation axis of a drive shaft of a portable power tool, which drive shaft is provided to drive the working tool. "Substantially parallelwise" is intended here to mean, in particular, an alignment of a direction relative to a reference direction, in particular in one plane, the direction deviating from the reference direction by, in particular, less than 8°, advantageously less than 5°, and particularly advantageously less than 2°. A "clamping element" is to be understood to mean, in particular, an element provided to transmit a clamping force, which is preferably generated by a spring unit. Preferably, the clamping element is at least partially disposed in a hollow shaft and mounted, in particular, on bearing means that are disposed on the hollow shaft. A "clamping head" is to be understood here to mean, in particular, a component having at least one clamping surface that, for the purpose of securely clamping the working tool in the axial direction, bears at least against a partial surface of the working tool, and that applies a clamping force to the working tool along the axial direction and presses the working tool, in particular, against a tool receiver. A "tool receiver" is to be understood to mean, in particular, a component provided to receive a working tool in a receiving region, and to effect a form-fitting and/or force-fitting connection with the working tool in the circumferential direction. In particular, the tool receiver is connected to the drive shaft in a form-fitting and/or materially bonded manner. A "receiving region" is to be understood to mean, in particular, a near region of the tool receiver that is completely filled by a working tool securely clamped in the clamping unit. A "free end" of the clamping unit is to be understood to mean, in particular, a region of the clamping unit that is freely accessible by an operator, such that, preferably, it is possible to dispense with use of a tool and, in particular, to dispense with removal of housing parts. A "guide unit" is to be understood to mean, in particular, a unit provided to constrain a mounting movement that differs from a purely axial mounting movement, a movement about and/or along the axial direction, and which is distinguished, in particular, from a guide unit that allows a non-mounted working tool, through a single translational movement, to move into the receiving region of the tool receiver in a movement direction that is at least substantially parallel to the axial direction. Furthermore, the guide unit, in particular following an adjustment of an element of the guide unit, can have sufficient clearance to enable the working tool to tilt by an angle of up to 50° in respect of a plane whose normal vector is oriented at least substantially parallelwise in relation to the axial direction. A "substantial difference" of a movement direction from the axial direction is to be understood to mean, in particular, that the movement direction and the axial direction enclose an angle that is greater than 30°, advantageously greater than 60°, and preferably greater than 85°. The design of the tool clamping device according to the disclosure advantageously enables the working tool to be securely clamped and/or released without the use of tools.

Advantageously, the clamping head is integral with the clamping element. "Integral with" is to be understood here to mean, in particular, connected at least in a materially bonded manner, for example by a welding process, an adhesive bonding process, an injection process and/or by another process considered appropriate by persons skilled in the art, and/or, advantageously, formed in one piece, such as, for example, by being produced from a casting and/or by being produced in a single- or multi-component injection process and, advantageously, from a single blank. It is also conceivable, however, for the clamping head to be connected to the clamping element by means of a form-fitting and/or force-fitting connection, in particular in a rotationally fixed manner. The fact that the clamping head is designed so as to be integral with the clamping element makes it possible, advantageously, to realize savings in assembly work and costs.

In a further design of the disclosure, it is proposed that the guide unit have a receiving region that, as viewed in a clamping direction, is disposed at least partially behind the clamping head of the clamping element. A "clamping direction" is to be understood to mean, in particular, a direction in which the clamping head, when in an operating state with a securely clamped working tool, exerts a force upon the working tool. Advantageously, an axial overlap with a clamping surface of the clamping head can be achieved through the movement of the working tool. The expression "axial overlap" is intended here to define, in particular, an overlap, in particular of partial regions, of at least two components along the axial direction, wherein, in particular, a straight line along the axial direction intersects the two components. Preferably, the clamping surface of the clamping head overlaps at least a partial region of the working tool along the axial direction, at least in one operating state, in which the working tool is securely clamped on a tool receiver by means of the clamping head. In particular, an axial overlap is maintained in the case of a change of position, preferably one resulting from a rotation about an axis of a shaft of the working tool. In particular, it is possible for the working tool to be securely clamped and/or released without the use of tools.

It is additionally proposed that the clamping head be disposed eccentrically in relation to a longitudinal axis of the clamping element. In the case of the clamping head being integral with the clamping element, a clamping head is to be understood to mean, in particular, a smallest part of the clamping element that is delimited by a plane whose normal vector is disposed substantially parallelwise in relation to the axial direction, which plane, as viewed from the free end, is located behind the clamping surface, and includes at least the clamping surface. That an element is disposed "eccentrically" in relation to an axis is to be understood to mean, in particular, that a centroid, preferably a geometric centroid, of the element is at a greater distance from the axis than at least 3%, advantageously at least 8%, and preferably at least 20% of a maximum extent of the element. A "longitudinal axis" of the clamping element is to be understood to mean, in particular, an axis of the clamping element that is substantially parallel to the axial direction when the clamping element is in a mounted state. In particular, an axial overlap of the clamping head with the working tool can be achieved in a simple manner.

It is furthermore proposed that the clamping head have a chamfer, at least on a side that faces away from a clamping surface. In particular, a smallest extent of the chamfer is greater than 1 mm, and advantageously greater than 2 mm. Advantageously, the chamfer has an angle in relation to the longitudinal axis of the clamping element that deviates by less than 40°, in particular less than 20°, and preferably less than 5° from an angle of 45°. In particular, ease of mounting can be achieved.

Preferably, the clamping head has at least one clamping surface that is disposed asymmetrically, preferably eccentrically, in respect of a longitudinal axis of the clamping element. In particular, an axial overlap of the clamping head with the working tool can be achieved in a simple manner.

In a further design, it is proposed that the clamping unit have a clamping distance of between 1.5 mm and 3 mm in length. In particular, the clamping head is moved by the clamping distance during a complete operation of mounting and clamping the working tool.

The disclosure is additionally based on a portable power tool, in particular a hand-held power tool having a spindle that can be driven in an oscillatory manner, having a tool clamping device according to the disclosure. A "portable power tool" is to be understood here to mean, in particular, a power tool, in particular a hand-held power tool, that can be transported by an operator without the use of a transport machine. The portable power tool has, in particular, a mass of less than 40 kg, preferably less than 10 kg, and particularly preferably less than 5 kg. Advantageously, a high degree of operating comfort can be achieved for an operator of the hand-held power tool.

The tool clamping device according to the disclosure in this case is not intended to be limited to the application and embodiment described above. In particular, the tool clamping device according to the disclosure, for the purpose of implementing a functioning mode described herein, can have a number of individual elements, components and units that differs from a number stated herein.

BRIEF DESCRIPTION OF THE DRAWINGS

Further advantages are given by the following description of the drawings. The drawings show an exemplary embodiment of the disclosure. The drawings, the description and the claims contain numerous features in combination. Persons skilled in the art will also expediently consider the features individually and combine them to create appropriate further combinations.

In the drawings.

DETAILED DESCRIPTION

Figure 1:
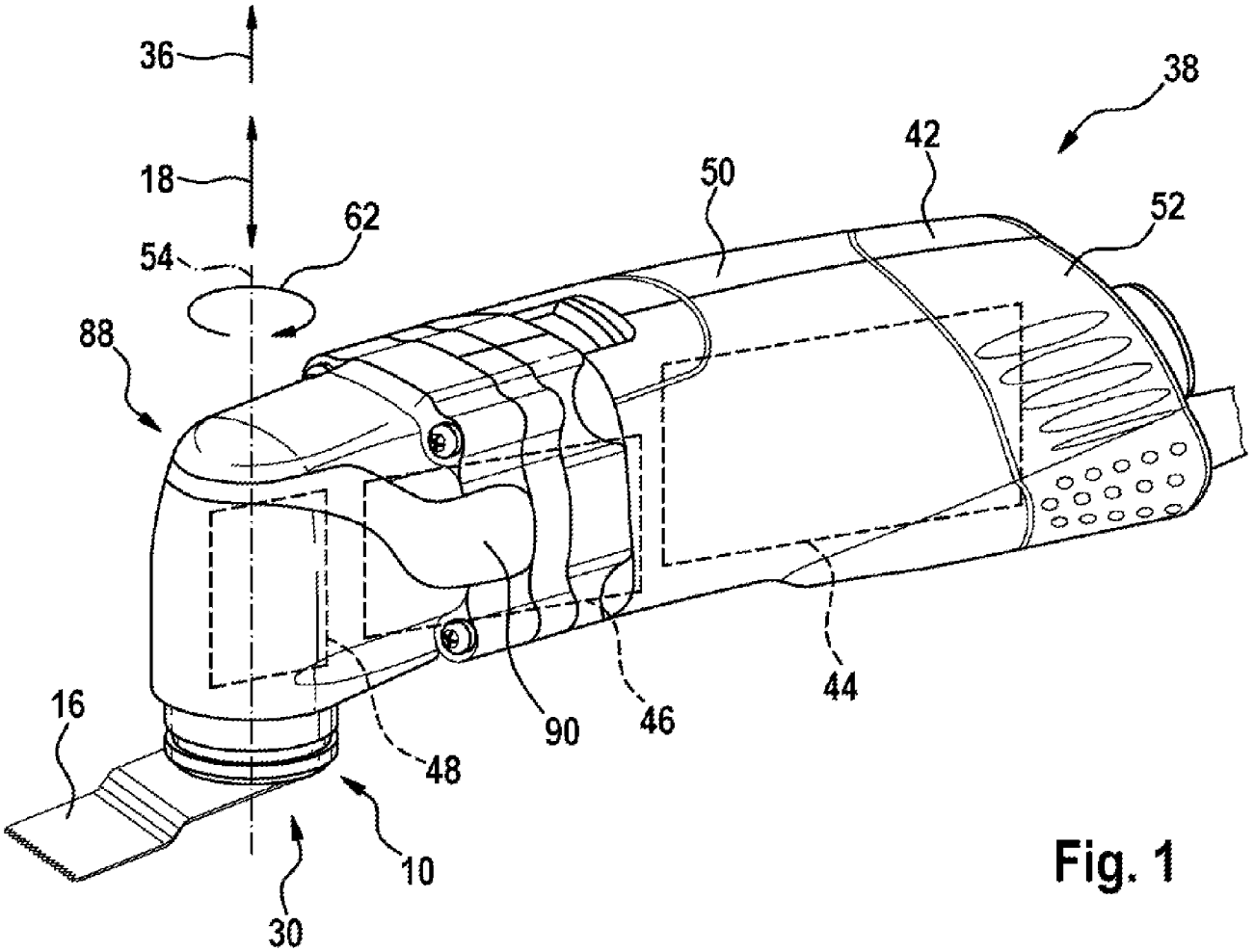
FIG. 1 shows a system according to the disclosure, comprising a power tool that has a tool clamping device according to the disclosure and a mounted working tool, in a schematic representation.

FIG. 1 shows a system consisting of an electrically operated portable power tool 38, and of a working tool 16, which is realized as a saw blade. The power tool has tool clamping device 10, realized as an oscillating-tool clamping device, which is provided for securely clamping the working tool 16 in the power tool 38. The portable power tool 38 comprises a power-tool housing 42, which encloses an electric-motor unit 44, a transmission unit 46 and an output unit 48 of the portable power tool 38. The power-tool housing 42 in this case comprises two housing half-shells 50, 52, which are detachably connected to each other along a plane running through an axial direction 18. It is also conceivable, however, for the power-tool housing 42 to have two or more pot-shaped housing parts that can be detachably connected to each other. The axial direction 18 runs along and/or parallelwise in relation to a rotation axis 54 of a hollow shaft 56, realized as a spindle 40, of the output unit 48 (FIG. 3). The hollow shaft 56 is provided, when in a mounted state, to drive a working tool 16 in an oscillating manner. An oscillating drive of the working tool 16 in this case is effected in a manner already known to persons skilled in the art, such as, for example, by means of a journal (not represented in greater detail here) of the transmission unit 46, which journal is disposed eccentrically on a drive shaft of the electric-motor unit 44 and, by means of a rocker arm and rocker sleeve (not represented in greater detail here) of the transmission unit 46, drives the hollow shaft 56 when the portable power tool 38 is in operation. The hollow shaft 56, realized as a spindle 40, can thus be driven in an oscillating manner. The working tool 16 can be fastened to a tool receiver 58 of the output unit 48 for the purpose of performing material-removing work on workpieces. The tool receiver 58 is integral with the hollow shaft 56. A pivoting motion of the hollow shaft can be transmitted to the tool receiver 58. The tool receiver 58 has twelve latching cams 66, which are distributed uniformly along a circle and which are provided to be connected in a form-fitting manner to twelve driving recesses 60 realized on the working tool 16 (FIG. 2).

The tool clamping device comprises a clamping unit 12. The clamping unit has a clamping element 14 for securely clamping a working tool 16 in an axial direction 18, and has a clamping head 20, which is disposed on the clamping element 14 and which is provided for clamping the working tool 16 at a free end 30 of the clamping unit 12. The clamping element 14 is partially disposed in the hollow shaft 56. The clamping element 14 is mounted in a bearing element 24 of the hollow shaft 56. The clamping unit 12 additionally has a guide unit 22, which is provided, when in an operating state that differs from an operating state with a securely clamped working tool 16, to guide a movement of the working tool 16 along a movement direction 34 that differs substantially from the axial direction 18. The guide unit 22 is constituted by the clamping element 14, the clamping head 20 disposed on the clamping element 14, and the tool receiver 58.

The clamping head 20 is integral with the clamping element 14. The guide unit 22 has a receiving region 59, which, as viewed in a clamping direction 36, is disposed at least partially behind the clamping head 20 of the clamping element 14. The clamping head 20 is disposed eccentrically in relation to a longitudinal axis 28 of the clamping element 14. The clamping head has a clamping surface 72 that is disposed asymmetrically in respect of the longitudinal axis 28 of the clamping element 14. The clamping head 20 has a chamfer 26 on a side that faces away from the clamping surface 72. The clamping unit 12 has a clamping distance 32 of 2 mm in length.

Figure 2:
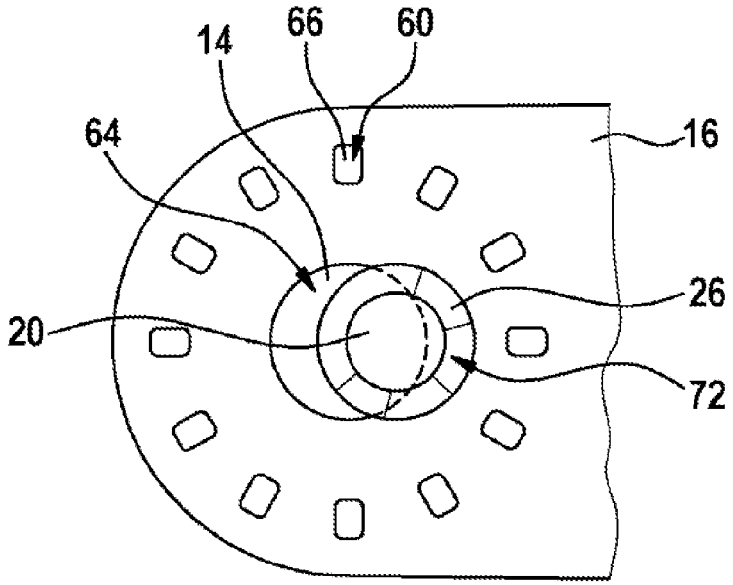
FIG. 2 shows a view of the clamping unit in the clamping direction.
Figure 3:
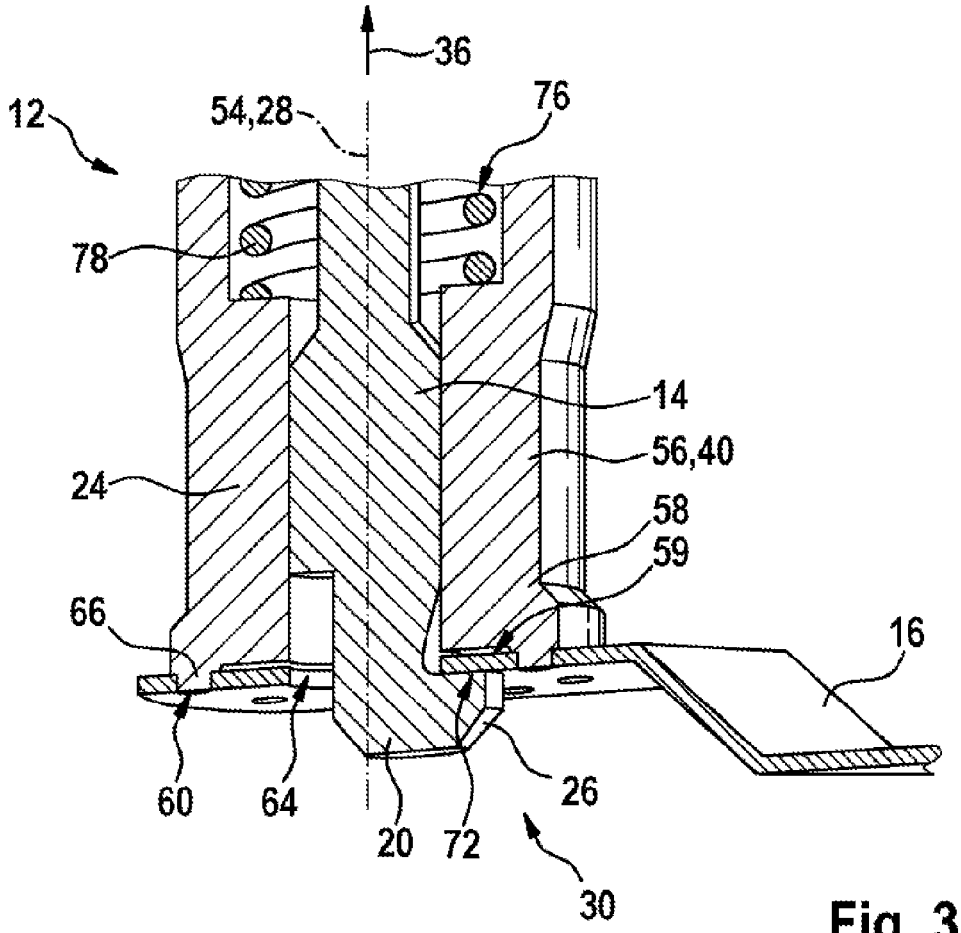
FIG. 3 shows a detail portion of a section along the rotation axis of the hollow shaft, with a mounted and securely clamped working tool, in a schematic representation.

FIG. 2 shows the power-tool clamping device 10 in a view in the clamping direction 32. The working tool 16 is connected to the tool receiver 58 in the circumferential direction 62 by means of the latching cams 66 and the driving recesses 60. A clamping head 20 disposed on the clamping element 14, eccentrically in relation to the longitudinal axis 28 of the clamping element 14, has a clamping surface 72. The clamping surface 72 is disposed eccentrically in respect of the longitudinal axis 28 of the clamping element 12. The clamping head 20 has a chamfer 26, which facilitates placement of the working tool 16, which has a placement hole 64. The chamfer 26 has an angle of inclination of 45° relative to the longitudinal axis 28 of the clamping element 14, and a width of 2 mm. The placement hole 64 is disposed centrally between the driving recesses 60 of the working tool 16. Also conceivable, however, is a design in which the clamping head 20 is disposed on the longitudinal axis 28 of the clamping element 14 and is mushroom-shaped, and a working tool 16 has a placement hole 64 disposed eccentrically in relation to a central point between the driving recesses 60.

FIG. 3 shows a schematic detail portion of the output unit 48 and of the tool clamping device 10 when in an operating state, with a securely clamped working tool 16. The clamping unit 12 has a spring unit 76. By means of a biased spiral compression spring 78, the spring unit 76 generates a clamping force that is transmitted to the clamping head 20 via the clamping element 14. By means of this clamping force, the clamping head 20 presses the working tool 16, in the clamping direction 36, against the tool receiver 58.

The working tool 16 is disposed in a receiving region 59. The latching cams 66 of the tool receiver 58 engage in the driving recesses 60 of the working tool 16. The receiving region 59 is disposed partially behind the clamping head 20, as viewed in the clamping direction 36. A clamping surface 72 of the clamping head 20 is disposed on the back side of the clamping head 20, as viewed in the clamping direction 36. In an alternative design, the clamping force is generated by means of a screw thread, through tightening of a nut and/or a screw. Additionally conceivable are designs in which disk springs are used instead of the spiral compression spring 78.

To enable the clamping element 14 to be actuated without the use of tools, the clamping unit 12 has an operating unit 88 (FIG. 1). The operating unit 88 comprises an operating lever 90, which is mounted so as to be rotatable about the rotation axis 54 of the hollow shaft 56. The operating unit 88 additionally has a mechanism (not represented in greater detail here) provided to convert a rotary motion of the operating lever 90 about the rotation axis 54 into a translational movement of the clamping element 14 along the axial direction 18. The mechanism in this case can be constituted by a transmission, a control curve or other mechanisms, already known to persons skilled in the art, for converting a rotary motion into a translational movement. In an operating state, with a securely clamped working tool, the operating unit 88 is decoupled from an oscillating motion of the clamping element 14 during operation of the portable power tool 38, in a manner already known to persons skilled in the art. In an operating state that differs from an operating state with a securely clamped working tool, the operating unit 88 is coupled to the clamping element 14 and/or to the clamping head 20, in a manner already known to persons skilled in the art, for the purpose of releasing a clamping force.

Figure 4:
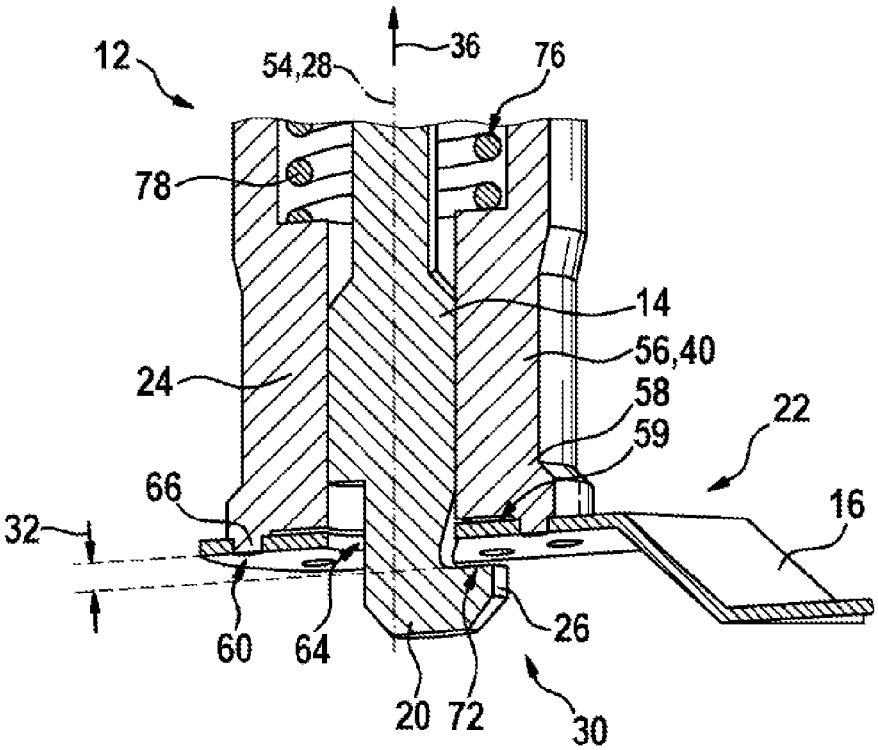
FIG. 4 shows a further detail portion of the tool clamping device according to the disclosure, with a released working tool.

FIG. 4 shows the portion according to FIG. 3 in an operating state that differs from a state with a securely clamped working tool 16. In order to achieve this operating state, the operating lever 90 has been actuated. The clamping element 14 has been displaced by the operating unit 88, contrary to the clamping direction 36, by a clamping distance 32. The length of the clamping distance 32 is 2 mm.

Figure 5:
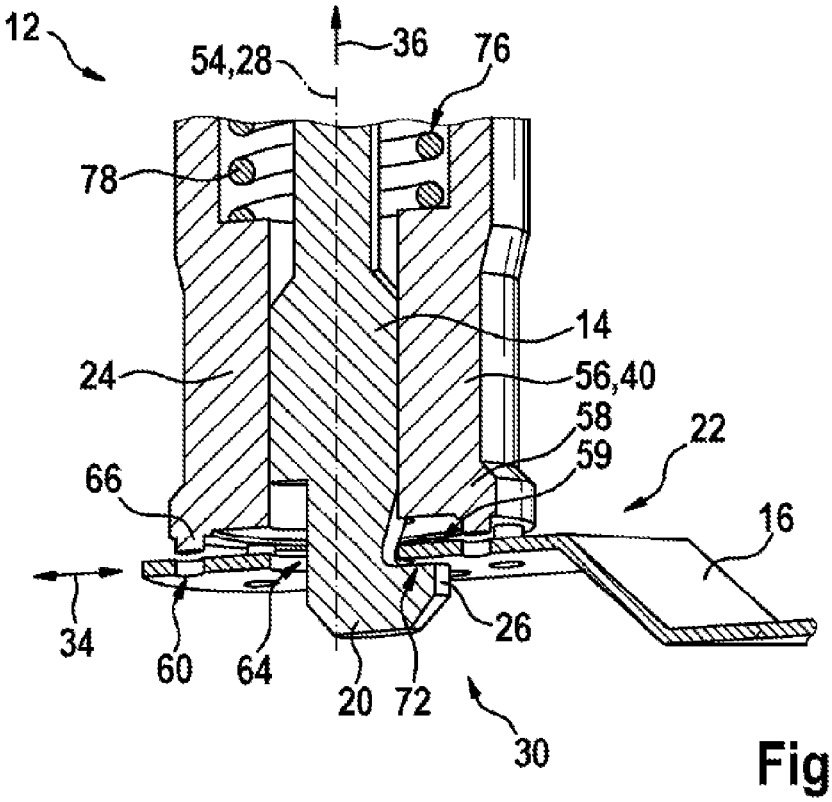
FIG. 5 shows a further detail portion of the tool clamping device according to the disclosure, in a schematic representation.

In FIG. 5, the working tool 16 has been released from the receiving region. The clamping head 20 of the clamping element 14 and the tool receiver 58 constitute a guide unit 22, which guides a movement of the working tool 16 in the movement direction 34. The movement direction 34 is substantially perpendicular to the rotation axis 54 of the hollow shaft 56, and consequently to the axial direction 18. Following movement of the working tool 16 along the movement direction 34 by a distance of 3 mm, the working tool 16 is in a position in which the placement hole 64 can be guided over the clamping head 20 in the axial direction, and the working tool 16 can thus be released from the portable power tool 38. Both the clamping element 14 and the clamping head 20 remain connected to the tool clamping device 10 during demounting or mounting of the working tool 16. In the case of mounting of the working tool 16, placement of the placement hole 64 over the clamping head 20 is assisted by the chamfer 26. The entire operation of mounting or demounting the working tool 16 is performed without the use of tools.

The invention claimed is:

1. A portable power tool, comprising:

a spindle defining a hollow shaft and a receiver portion; and a clamping unit including:

at least one clamping element partially disposed in the hollow shaft and movable in an axial direction therein, and at least one clamping head disposed on the clamping element outside of the hollow shaft, defining a clamping surface facing toward the receiver portion, and configured to clamp a working tool in the axial direction between the clamping surface and the receiver portion of the clamping unit, wherein the clamping unit defines a guide unit configured to guide at least one movement of the working tool along at least one movement direction that differs substantially from the axial direction in at least one operating state.

2. The portable power tool as claimed in claim 1, wherein the clamping head is integral with the clamping element.

3. The portable power tool as claimed in claim 1, wherein the guide unit has a receiving region that, as viewed in a clamping direction, is disposed at least partially behind the clamping head of the clamping element.

4. The portable power tool as claimed in claim 1, wherein the clamping head is disposed eccentrically in relation to a longitudinal axis of the clamping element.

5. The portable power tool as claimed in claim 1, wherein the clamping head has a chamfer at least on a side that faces away from a clamping surface.

6. The portable power tool as claimed in claim 1, wherein the clamping surface is disposed asymmetrically in respect of a longitudinal axis of the clamping element.

7. The portable power tool as claimed in claim 1, wherein the clamping unit has a clamping distance of between 1.5 mm and 3 mm in length.

8. The portable power tool as claimed in claim 1, wherein the portable power tool is configured as an oscillating-tool clamping device.

9. A portable power tool, comprising:

a tool clamping device including:

a spindle defining a hollow shaft and a receiving portion; and a clamping unit including:

at least one clamping element partially disposed in the hollow shaft and movable in an axial direction therein, and at least one clamping head disposed on the clamping element outside of the hollow shaft, defining a clamping surface facing toward the receiving portion, and configured to clamp a working tool in the axial direction between the clamping surface and the receiving portion of the clamping unit, wherein the clamping unit defines a guide unit configured to guide at least one movement of the working tool along at least one movement direction that differs substantially from the axial direction in at least one operating state.

10. The portable power tool as claimed in claim 9, wherein the spindle is configured to be driven in an oscillatory manner.

11. A system, comprising:

at least one portable power tool including:

a tool clamping device, the tool clamping device including:

a spindle defining a hollow shaft and a receiving portion; and a clamping unit including:

at least one clamping element partially disposed in the hollow shaft and movable in an axial direction therein, and at least one clamping head disposed on the clamping element outside of the hollow shaft, defining a clamping surface facing toward the receiving portion, and configured to clamp a working tool in the axial direction between the clamping surface and the receiving portion of the clamping unit, wherein the clamping unit defines a guide unit configured to guide at least one movement of the working tool along at least one movement direction that differs substantially from the axial direction in at least one operating state; and a working tool configured to securely clamp in the tool clamping device of the portable power tool.

* * * * *